US011320777B2

(12) United States Patent
Hori

(10) Patent No.: US 11,320,777 B2
(45) Date of Patent: May 3, 2022

(54) PHOTOSENSITIVE DRUM, PROCESS UNIT, AND IMAGE FORMING APPARATUS

(71) Applicant: SHARP KABUSHIKI KAISHA, Sakai (JP)

(72) Inventor: Takashi Hori, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/369,627

(22) Filed: Jul. 7, 2021

(65) Prior Publication Data

US 2022/0043386 A1 Feb. 10, 2022

(30) Foreign Application Priority Data

Aug. 7, 2020 (JP) ..... JP2020-134480

(51) Int. Cl.
*G03G 15/00* (2006.01)
*G03G 21/16* (2006.01)

(52) U.S. Cl.
CPC ..... *G03G 15/751* (2013.01); *G03G 21/1647* (2013.01); *G03G 21/1671* (2013.01); *G03G 2221/1606* (2013.01)

(58) Field of Classification Search
CPC ..... G03G 15/751; G03G 21/1647; G03G 21/1671; G03G 2221/1606
See application file for complete search history.

(56) References Cited

U.S. PATENT DOCUMENTS 10,185,279 B1 * 1/2019 Sadik ..... G03G 15/75
2007/0253734 A1 * 11/2007 Shin ..... G03G 15/751 399/159
2010/0021206 A1 * 1/2010 Itabashi ..... G03G 15/751 399/159
2014/0072342 A1 * 3/2014 Iijima ..... G03G 15/757 399/167
2017/0364019 A1 * 12/2017 Onishi ..... G03G 15/751

FOREIGN PATENT DOCUMENTS

JP 2005-331660 A 12/2005

* cited by examiner

*Primary Examiner* — Sophia S Chen
(74) *Attorney, Agent, or Firm* — ScienBiziP, P.C.

(57) ABSTRACT

In a photosensitive drum, a drum flange is press-fitted to each end of a drum element tube. The drum flange includes a flange facing the drum element tube, and a press-in boss formed on a drum-facing surface side of the flange and press-fitted to the inner circumferential side of the drum element tube. The outer circumferential surface of the press-in boss is configured so that partial cylindrical surfaces to be in contact with the inner circumferential surface of the drum element tube and oppositely-facing partial cylindrical surfaces not to be in contact with the inner circumferential surface of the drum element tube are alternately formed along the circumferential direction. First openings formed to penetrate at least a part of the press-in boss are respectively provided on the proximal end side of the partial cylindrical surfaces in the press-in boss.

6 Claims, 9 Drawing Sheets

A-A

PHOTOSENSITIVE DRUM, PROCESS UNIT, AND IMAGE FORMING APPARATUS

BACKGROUND OF THE INVENTION

Field of the Invention

The present disclosure relates to a photosensitive drum, a process unit, and an image forming apparatus.

Description of the Background Art

An image forming apparatus that electrophotographically forms an image has a photosensitive drum in an image former. The photosensitive drum is usually configured so that a drum flange is press-fitted to each of the opposite ends of a drum element tube (see, for example, Japanese Unexamined Patent Application Publication No. 2005-331660).

SUMMARY OF THE INVENTION

In a photosensitive drum disclosed in Japanese Unexamined Patent Application Publication No. 2005-331660, both the inner circumferential surface of a drum element tube and the outer circumferential surface of a drum flange have a cylindrical shape. The drum flange is press-fitted to entirely around the drum element tube, so that there is no relief allowance for the drum flange during press-fitting. Therefore, variations in dimensional accuracy, etc. of the drum flange may cause variations in pressure between the drum element tube and the drum flange, thereby causing distortion of the drum element tube. Such distortion of the drum element tube in turn results in runout of the photosensitive drum during rotation thereof, whereby the problem arises that image quality in the image forming apparatus deteriorates.

The present disclosure has been made in view of the aforementioned problem, and an object of the present disclosure is to provide a photosensitive drum, a process unit, and an image forming apparatus, in which occurrence of the distortion caused by press-fitting of the drum flange is able to be suppressed.

In order to solve the foregoing problem, a photosensitive drum that is a first aspect of the disclosure includes a drum element tube and a drum flange to be press-fitted to an end of the drum element tube, in which the drum flange includes a flange disposed to face an end face of the drum element tube, and a press-fitting formed on a drum-facing surface of the flange so as to be press-fitted to an inner circumferential side of the drum element tube, the press-fitting has an outer circumferential surface formed with a plurality of contacts to be in contact with an inner circumferential surface of the drum element tube and a plurality of non-contacts to be not in contact with the inner circumferential surface of the drum element tube, the contacts and the non-contacts being circumferentially alternated, a first opening is formed on a proximal end side of each contact of the press-fitting so as to penetrate a part of the press-fitting.

According to the above-described configuration, the contacts and the non-contacts with respect to the drum element tube are alternately formed along the circumferential direction in the press-fitting, so that when the drum flange is press-fitted to the drum element tube, the non-contacts serve as relief allowance, whereby the contact pressure between the drum element tube and the contacts is able to be made uniform. As a result, occurrence of distortion of the drum element tube caused by press-fitting the drum flange is able to be suppressed, and therefore runout of the photosensitive drum during its rotation is able to be suppressed. Furthermore, a first opening is provided on the proximal end side of each contact, and makes more uniform the contact pressure between the drum element tube and the contacts, whereby occurrence of distortion of the drum element tube caused by press-fitting the drum flange is able to be further suppressed.

Furthermore, the photosensitive drum described above may be configured so that each contact has an arc shape when viewed from the axial direction of the photosensitive drum.

According to the above-described configuration, the contacts are brought into surface contact with the inner circumferential surface of the drum element tube, whereby a contact area between the contacts and the drum element tube increases, so that the drum element tube is able to be held firmly.

Furthermore, the above-described photosensitive drum may be configured so that each of the non-contacts has an oppositely-facing circular arc shape that is concave toward the center of the press-fitting when viewed from the axial direction of the photosensitive drum.

According to the above-described configuration, the non-contacts each having the oppositely-facing circular arc shape generate a force for pressing the contacts against the inner circumferential surface of the drum element tube, so that the drum element tube is able to be held firmly.

Furthermore, the above-described photosensitive drum may be configured to further include a grounding plate attached to the drum flange, in which the drum flange includes a shaft holding boss formed at a center of the flange inside the press-fitting, the shaft holding boss holding a drive shaft for rotationally driving the photosensitive drum, the grounding plate includes a ring disposed in contact with the drum-facing surface of the flange between the press-fitting and the shaft holding boss, the ring being centrally provided with a second opening through which the shaft holding boss extends, a drum contact claw formed to extend radially outward from an outer circumferential edge of the ring, and a shaft contact claw formed to extend radially inward from an inner circumferential edge of the second opening, and when the drum contact claw is inserted in the first opening, a tip of the drum contact claw protrudes radially outward from an outer circumferential surface of the press-fitting, whereby the drum claw is brought into contact with an end face or an inner circumferential surface of the drum element tube, the shaft contact claw is brought into contact with an outer circumferential surface of the drive shaft held by the shaft holding boss.

According to the configuration described above, with the grounding plate being in contact with the drum-facing surface of the flange, the drum contact claw is brought into contact with the drum element tube and the shaft contact claw is brought into contact with the drive shaft, so that the drum element tube is able to be grounded via the grounding plate and the drive shaft. Furthermore, the drum contact claw is brought into contact with the end face or the inner circumferential surface (near the end face) of the drum element tube, so that production of metal powder due to rubbing of the inner circumferential surface of the drum element tube by the drum contact claw is able to be prevented or suppressed.

Furthermore, in order to solve the foregoing problem, a process unit according to a second aspect of the disclosure is removably loaded in the image forming apparatus, and includes a photosensitive drum around which at least some of the functional components necessary for electrophotographically forming an image are arranged along a rotational direction of the photosensitive drum, and the photosensitive drum is the above-described photosensitive drum.

Furthermore, in order to solve the aforementioned problem an image forming apparatus which is a third aspect of the present disclosure includes the process unit described above.

The photosensitive drum, process unit, and image forming apparatus of the present disclosure provides the relief allowance to a contact of the press-fitting when the drum flange is press-fitted to the drum element tube, whereby a contact pressure between the drum element tube and the contact is able to be made uniform. As a result, an advantageous effect is produced that occurrence of distortion of the drum element tube caused by press-fitting of the drum flange is able to be suppressed, and therefore runout of the photosensitive drum during its rotation is able to be suppressed.

DESCRIPTION OF THE PREFERRED EMBODIMENTS

Embodiment 1

Figure 1:
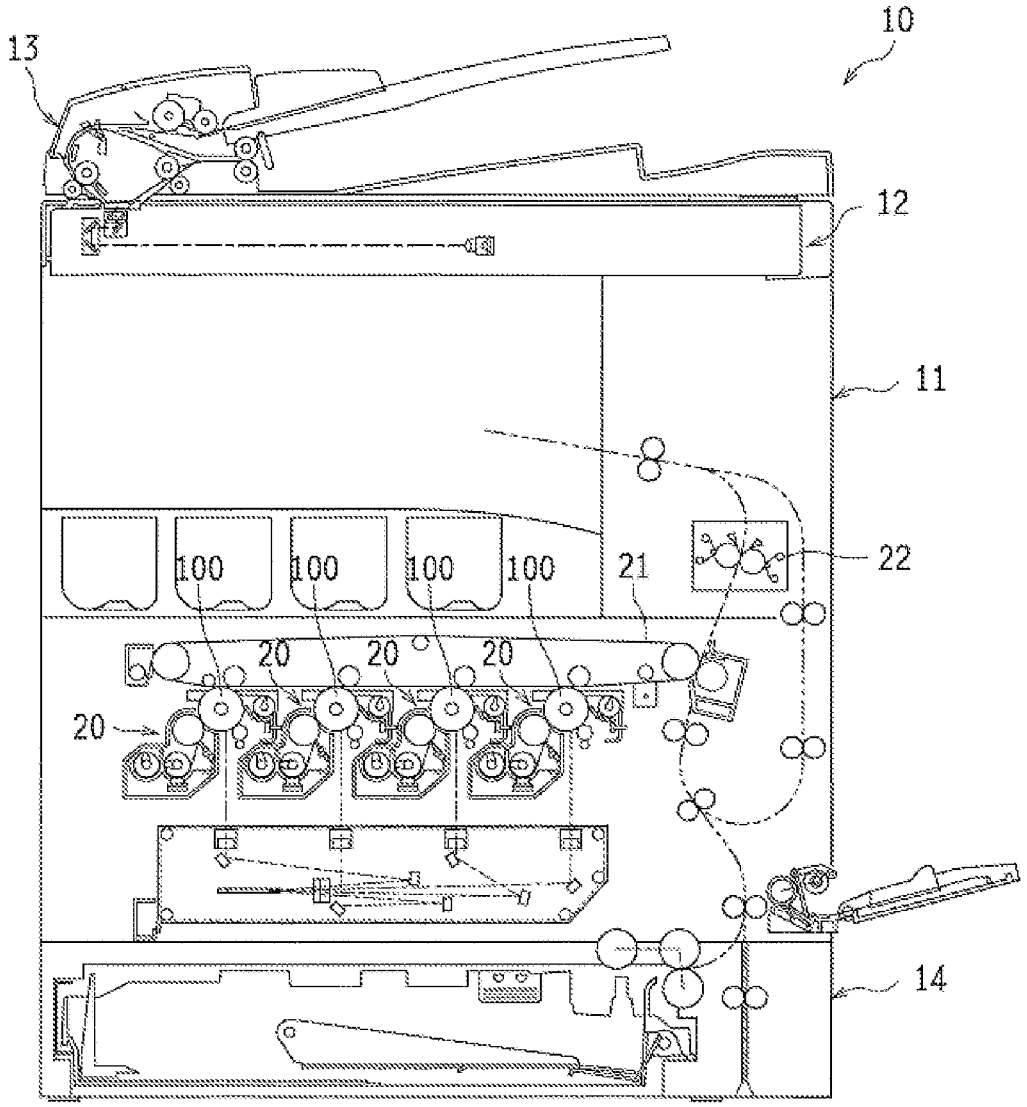
FIG. 1 is a schematic sectional view of an image forming apparatus, illustrating one embodiment of the present disclosure.

Hereinafter, embodiments of the present disclosure will be described in detail with reference to the drawings. FIG. 1 is a schematic configuration diagram illustrating one example of an image forming apparatus 10 to which the present disclosure is applied. Although the image forming apparatus 10 illustrated in FIG. 1 is a color image forming apparatus having a plurality of process units, the present disclosure is not limited thereto, and is also applicable to a monochrome image forming apparatus having a single process unit.

As illustrated in FIG. 1, the image forming apparatus 10 may be constituted to include a main body 11, a document reader 12, a document feeder 13, and a sheet feeder 14. The main body 11 internally has an image former for printing an image on a recording sheet. The document reader 12 is located over the main body 11, and reads a document when copying the document. In an automatic reading mode, the document feeder 13 sequentially sends the documents placed on a document stacking tray one by one onto a document platen of the document reader 12. The sheet feeder 14 stocks the recording sheets, and feeds the recording sheets one by one to the main body 11 when forming an image.

The image forming apparatus 10 handles image data corresponding to a color image using black (K), cyan (C), magenta (M), and yellow (Y), or image data corresponding to a monochrome image using a single color (e.g., black). Therefore, the image forming apparatus 10 includes four process units 20 which are associated with black, cyan, magenta, and yellow, respectively. The process units 20 respectively form toner images according to the image data by using electrophotography technologies.

The toner images respectively formed by the process units 20 are sequentially transferred to and superimposed on an intermediate transfer belt 21. Consequently, a color toner image is formed on the intermediate transfer belt 21. Then, the color toner image formed on the intermediate transfer belt 21 is transferred onto the recording sheet, and a fuser device 22 heats and pressurizes the recording paper to fix the color toner image on the recording sheet.

Figure 2:
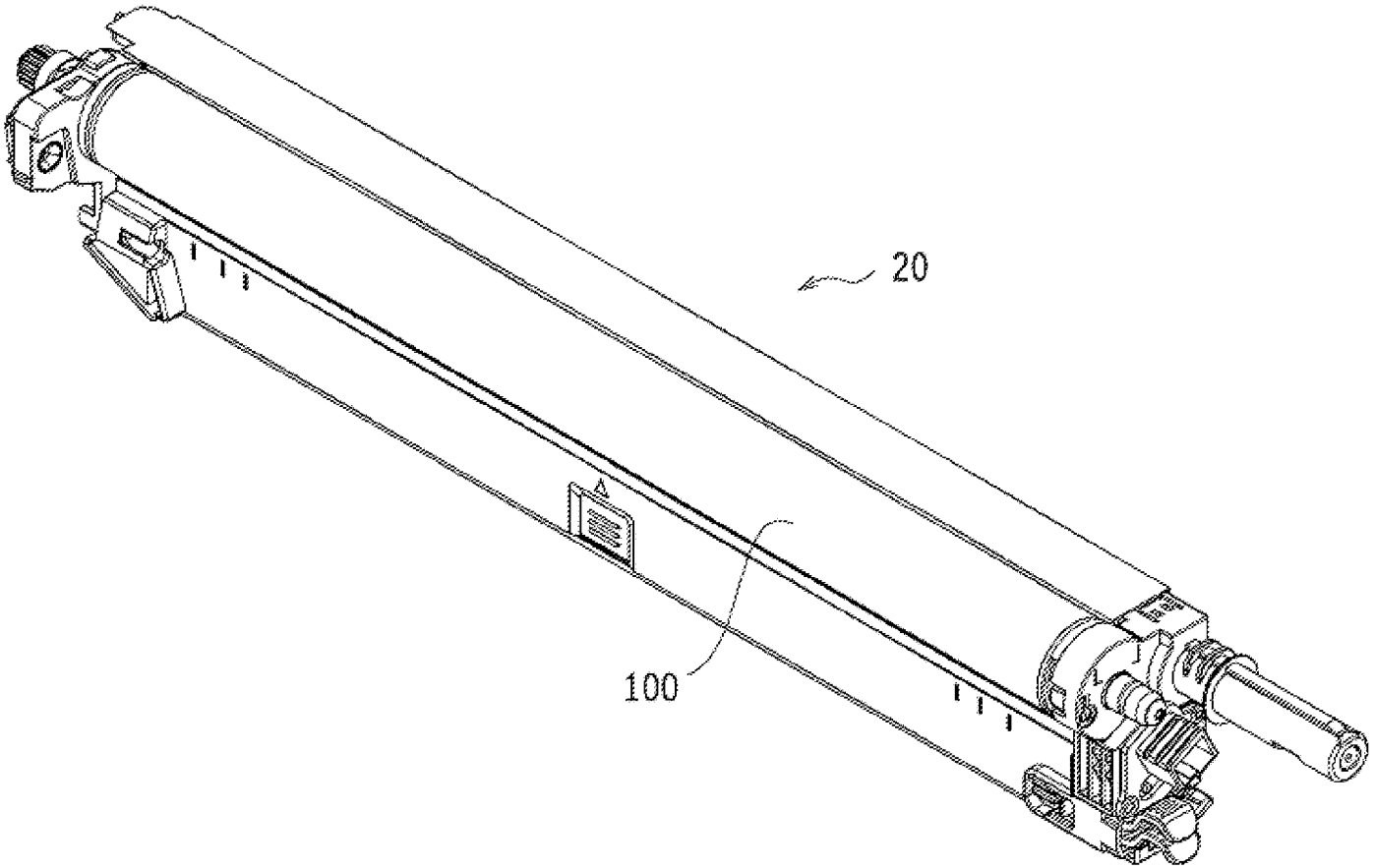
FIG. 2 is a perspective view illustrating a process unit.

As illustrated in FIG. 2, the process unit 20 is configured as a unit that is removably loaded in the image forming apparatus 10. Although the process unit 20 will not be described further because the process unit 20 performs image forming based on a well-known electrophotographic method, the process unit 20 has a configuration in which functional components such as a charger, a cleaner, a discharger, etc., (at least some of functional components necessary for electrophotographically forming an image) are arranged around a photosensitive drum 100 along the rotational direction of the photosensitive drum 100.

Figure 3:
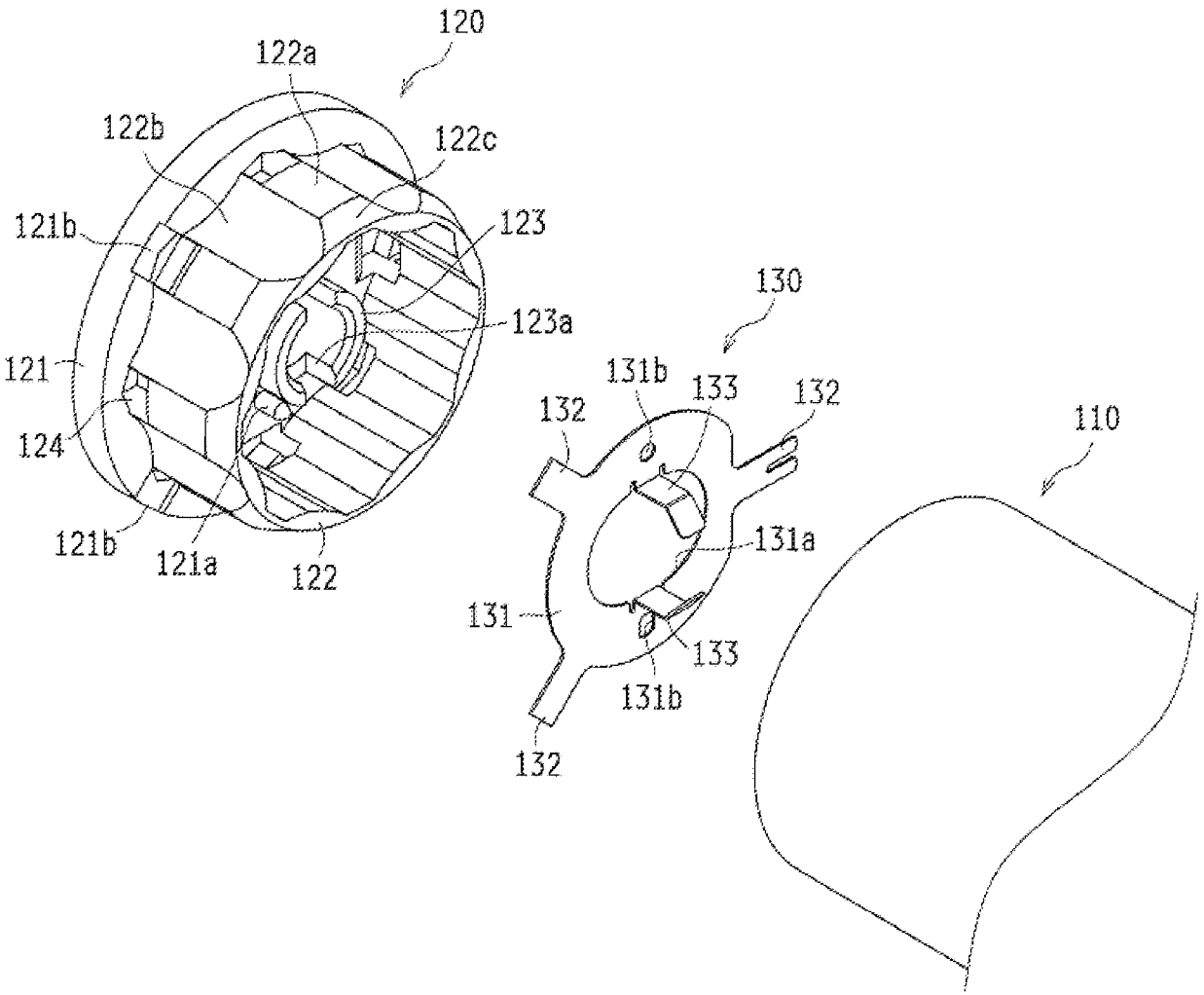
FIG. 3 is an exploded perspective view of a photosensitive drum according to Embodiment 1 as viewed from one end side thereof.

Next, a specific structure of the photosensitive drum 100 will be described. FIG. 3 is an exploded perspective view of the photosensitive drum 100 according to Embodiment 1 as viewed from one end side thereof. The photosensitive drum 100 is roughly composed of a drum element tube 110, drum flanges 120, and grounding plates 130. The drum element tube 110 has an aluminum tube on its radially innermost side, and a photosensitive layer is formed around the aluminum tube. The drum flange 120 is a resin member to be press-fitted to each of the opposite ends of the drum element tube 110. The grounding plate 130 is a metal plate for grounding the drum element tube 110, and is attached to the drum flange 120. When the drum flange 120 is press-fitted to the drum element tube 110, the grounding plate 130 is brought into contact with the inner circumferential surface or end face (i.e., a surface of the aluminum tube) of the drum element tube 110.

Figure 4:
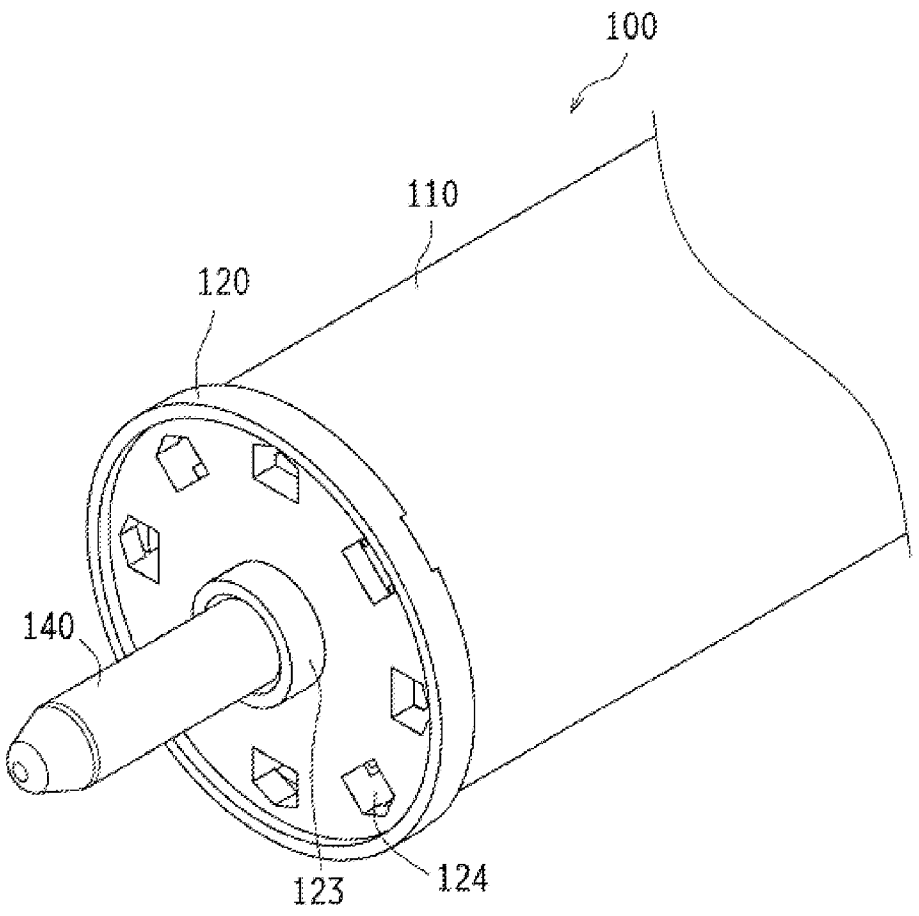
FIG. 4 is a perspective fragmentary view of the photosensitive drum with a drive shaft being mounted.

The drum flange 120 includes a flange 121, a press-in boss (press-fitting) 122, and a shaft holding boss 123. The flange 121 is formed in a generally disk-like shape having an outer circumference slightly larger than the outer circumference of the drum element tube 110, and is disposed so as to face the end face of the drum element tube 110 when the drum flange 120 is press-fitted to the drum element tube 110. The press-in boss 122 is formed in the flange 121 on a surface on a side facing the drum element tube 110 (drum-facing surface). The drum flange 120 is fixed to the drum element tube 110 by press-fitting the press-in boss 122 to the inner circumferential side of the drum element tube 110. The shaft holding boss 123 is formed at the center of the flange 121 inside the press-in boss 122. As illustrated in FIG. 4, the shaft holding boss 123 is provided for receiving insertion of a drive shaft 140 of the photosensitive drum 100, and holding the drive shaft 140. When the drive shaft 140 is rotated, the drive shaft 140 provides rotations of the photosensitive drum 100 accordingly.

Figure 5:
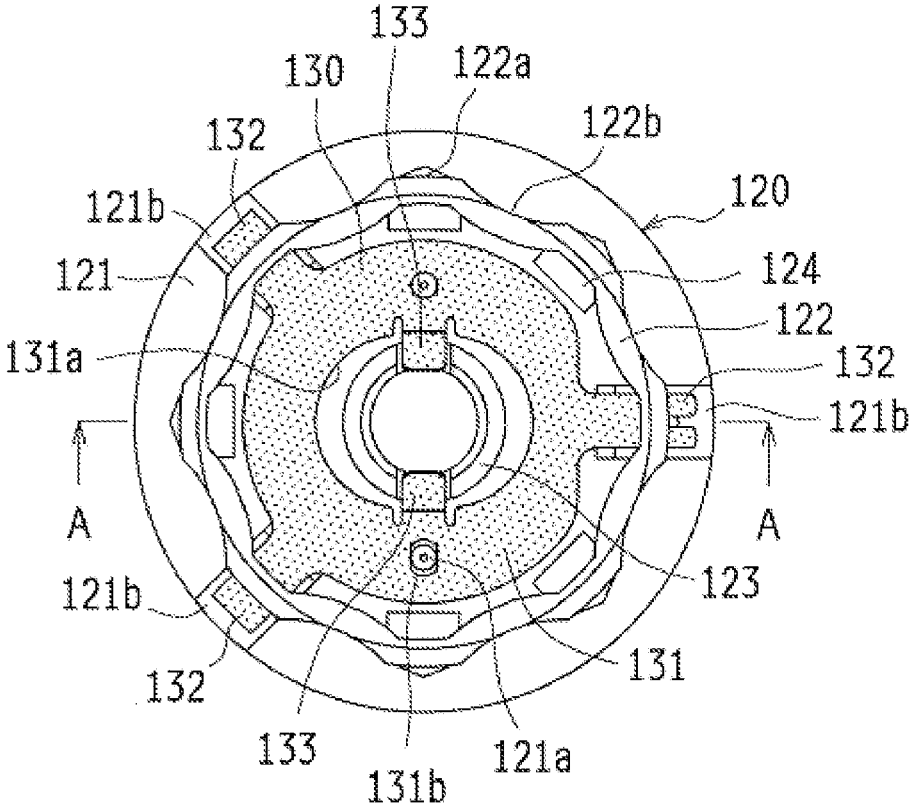
FIG. 5 is a plan view illustrating a drum flange with a grounding plate being attached.
Figure 6:
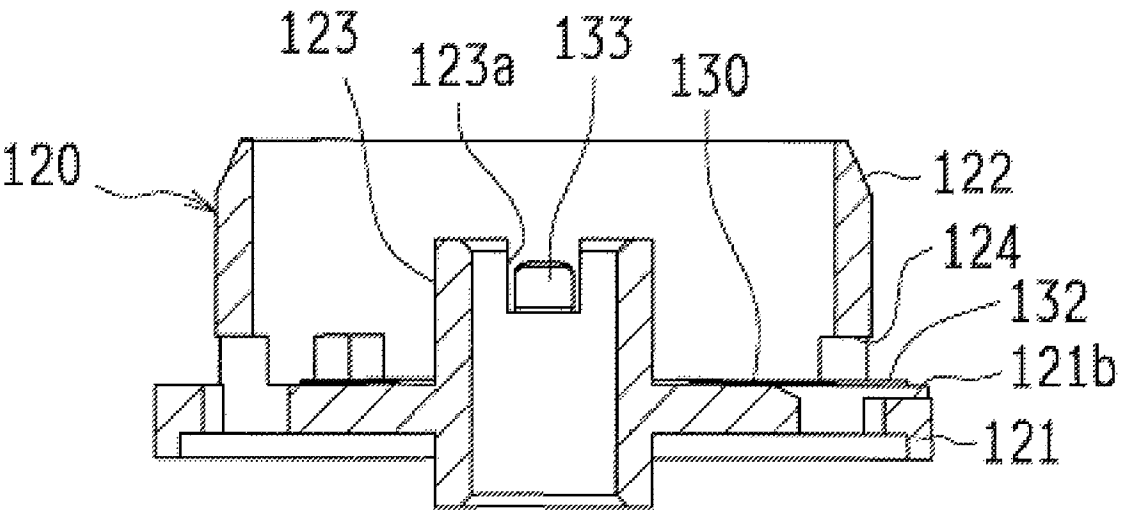
FIG. 6 is a cross-sectional view illustrating the drum flange with the grounding plate being attached.

FIG. 5 is a plan view illustrating the drum flange 120 with the grounding plate 130 being attached (when viewed from the drum press-in side along the drum rotation axis), and FIG. 6 is a cross-sectional view of FIG. 5 taken along line A-A.

As illustrated in FIG. 3 and FIG. 5, the press-in boss 122 in the drum flange 120 has an outer circumferential surface that is not formed in a cylindrical shape. It has a shape in which partial cylindrical surfaces 122*a* and oppositely-facing partial cylindrical surfaces 122*b* are alternately joined along the circumferential direction. In other words, as viewed from top. the outer circumference of the press-in boss 122 does not have a circular shape, but has a shape in which arcs and inverted-arcs (arcs which are concave toward the center of the press-in boss 122) are alternately joined.

All of the partial cylindrical surfaces 122*a* in the press-in boss 122 reside in one virtual cylindrical surface. The outer diameter of this virtual cylindrical surface is slightly larger than the inner diameter of the drum element tube 110. Thus, when the drum flange 120 is press-fitted to the drum element tube 110, the partial cylindrical surfaces 122*a* are brought into surface contact with the inner circumferential surface of the drum element tube 110. This allows the drum element tube 110 to be held firmly. A tapered surface 122*c* may be formed on the press-fit side of the partial cylindrical surface 122*a* to facilitate insertion of the press-in boss 122 into the drum element tube 110.

The oppositely-facing partial cylindrical surface 122*b*, however, is not brought into contact with the inner circumferential surface of the drum element tube 110 even when press-fitted to the drum element tube 110. Thus, the press-in boss 122 is configured so that contacts (partial cylindrical surfaces 122*a*) to be brought into contact with the drum element tube 110 and non-contacts (oppositely-facing partial cylindrical surfaces 122*b*) are alternately formed along the circumferential direction. With this configuration, when the drum flange 120 is press-fitted to the drum element tube 110, the oppositely-facing partial cylindrical surfaces 122*b* serve as relief allowance for the partial cylindrical surfaces 122*a*, and the contact pressure between the drum element tube 110 and the partial cylindrical surfaces 122*a* is able to be made uniform. As a result, occurrence of distortion of the drum element tube 110 caused by press-fitting of the drum flange 120 is able to be suppressed, and therefore runout of the photosensitive drum 100 during its rotation is able to be suppressed. In order that the drum flange 120 is able to hold the drum element tube 110 in stable, the number of the contacts (and the non-contacts) in the press-in boss 122 has to be at least two (preferably, at least three).

Each oppositely-facing partial cylindrical surface 122*b*, which is the non-contact, is concave toward the center of the press-in boss 122. This in turn makes it easier to produce a force to press the partial cylindrical surfaces 122*a* against the inner circumferential surface of the drum element tube 110 when press-fitting. This allows the press-in boss 122 in the drum flange 120 to firmly hold the drum element tube 110.

Furthermore, a first opening 124 is provided on the proximal end side of the oppositely-facing partial cylindrical surface 122*b* (on a side of the press-in boss 122 to be in contact with the flange 121). The first opening 124 is formed to penetrate at least a part of the press-in boss 122, and may be formed to further penetrate the flange 121. The first opening 124 makes the contact pressure between the drum element tube 110 and the partial cylindrical surface 122*a* more uniform, whereby occurrence of distortion of the drum element tube 110 due to press-fitting of the drum flange 120 is further suppressed.

That is, the press-fitting end of the press-in boss 122 is a free end, so that the oppositely-facing partial cylindrical surfaces 122*b*, which are the non-contacts, are able to sufficiently serve as the relief allowance. In contrast, the proximal end side end of the press-in boss 122 is a fixed end. Thus, when the first openings 124 are not formed on the proximal end side of the press-in boss 122, the oppositely-facing partial cylindrical surfaces 122*b*, which are the non-contacts, are not able to sufficiently serve as the relief allowance. When the first openings 124 are provided on the proximal end side of the press-in boss 122, the first openings 124 are able to serve as the relief allowance.

Next, the shape of the grounding plate 130 will be described with reference to FIG. 3, FIG. 5, and FIG. 6. The grounding plate 130, which is a generally ring-shaped member formed of sheet metal, includes a ring 131, a drum contact claw 132, and a shaft contact claw 133.

The ring 131 has a second opening 131*a* at the center thereof. The second opening 131*a* is of larger size than the outer circumference of the shaft holding boss 123 of the drum flange 120. The ring 131 is of smaller size than the inner circumference of the press-in boss 122. This allows the ring 131 to be disposed in contact with the drum-facing surface of the flange 121 between the press-in boss 122 and the shaft holding boss 123. Furthermore, a positioning hole 131*b* may be provided in the ring 131 of the grounding plate 130, and a positioning projection 121*a* may be provided in the drum-facing surface of the flange 121. That is, when the grounding plate 130 is attached to the drum flange 120, the grounding plate 130 may be positioned by mating the positioning hole 131*b* to the positioning projection 121*a*.

The drum contact claw 132 is formed to extend radially outward from the outer circumferential edge of the ring 131. It is preferable that a plurality of drum contact claws 132 is provided for each grounding plate 130 (in this example, provided at three locations). Furthermore, the drum contact claw 132 has a length in which when the grounding plate 130 is attached to the drum flange 120, the drum contact claw 132 is inserted into the first opening 124 of the press-in boss 122, and the tip of the drum contact claw 132 protrudes radially outward from the outer circumferential surface of the press-in boss 122.

When the drum flange 120 is press-fitted to the drum element tube 110, the tip of the drum contact claw 132 is sandwiched between the end face of the drum element tube 110 and the flange 121 of the drum flange 120, whereby electric conduction is provided between the grounding plate 130 and the drum element tube 110. A recess 121*b*, which serves as an axial relief allowance for the drum contact claw 132, may be provided on the drum-facing surface of the flange 121 at a position for disposing the drum contact claw 132. Providing the recess 121*b* makes it possible for the drum flange 120 to be press-fitted into the drum element tube 110 until the end face of the drum element tube 110 touches the flange 121, whereby the dimensional accuracy for mounting the drum flange 120 to the drum element tube 110 is improved.

Generally, a conventional photosensitive drum (for example, the photosensitive drum disclosed in Japanese Unexamined Patent Application Publication No. 2005-331660) is configured so that a grounding plate is attached to the distal end of a press-in boss in a drum flange, and a drum contact claw is brought into contact with the inner circumferential surface of a drum element tube in order to provide electric conduction. However, such a conventional configuration involves a problem that when the drum flange is press-fitted to the drum element tube, inclination of the grounding plate with respect to the drum flange and production of metal powder due to rubbing of the drum contact claw against the inner circumferential surface of the drum element tube may occur. In contrast, in the photosensitive drum 100 according to Embodiment 1, the grounding plate 130 is disposed in contact with the drum-facing surface in the flange 121, so that the grounding plate 130 is not inclined with respect to the drum flange 120. Furthermore, the drum contact claw 132 does not rub the inner circumferential surface of the drum element tube 110, so that production of metal powder is able to be prevented.

The shaft contact claw 133 is formed to extend radially inward from the inner circumferential edge of the second opening 131*a* in the ring 131. More specifically, the shaft contact claw 133 is bent so as to be raised to be perpendicular to the ring 131 at the position of the inner circumferential edge of the second opening 131*a*, and is further bent at its tip toward the inner circumference of the second opening 131*a*. It is preferable that a plurality of shaft contact claws 133 is provided for each grounding plate 130 (in this example, provided at two locations). When the grounding plate 130 is attached to the drum flange 120, the tip of the shaft contact claw 133 is located radially inward from the inner circumferential surface of the shaft holding boss 123. The shaft holding boss 123 has an axially extending notch 123*a* on its distal end side (drum press-in side), and a bent portion of the tip of the shaft contact claw 133 may be disposed in the notch 123*a*.

When the metal drive shaft 140 is inserted in the drum flange 120, the tip of the shaft contact claw 133 is brought into contact with the outer circumferential surface of the drive shaft 140, whereby electric conduction is provided between the grounding plate 130 and the drive shaft 140. This allows the grounding plate 130 to conduct to both the drum element tube 110 and the drive shaft 140, so that the drum element tube 110 is able to be grounded via the grounding plate 130 and drive shaft 140.

Embodiment 2

Figure 7:
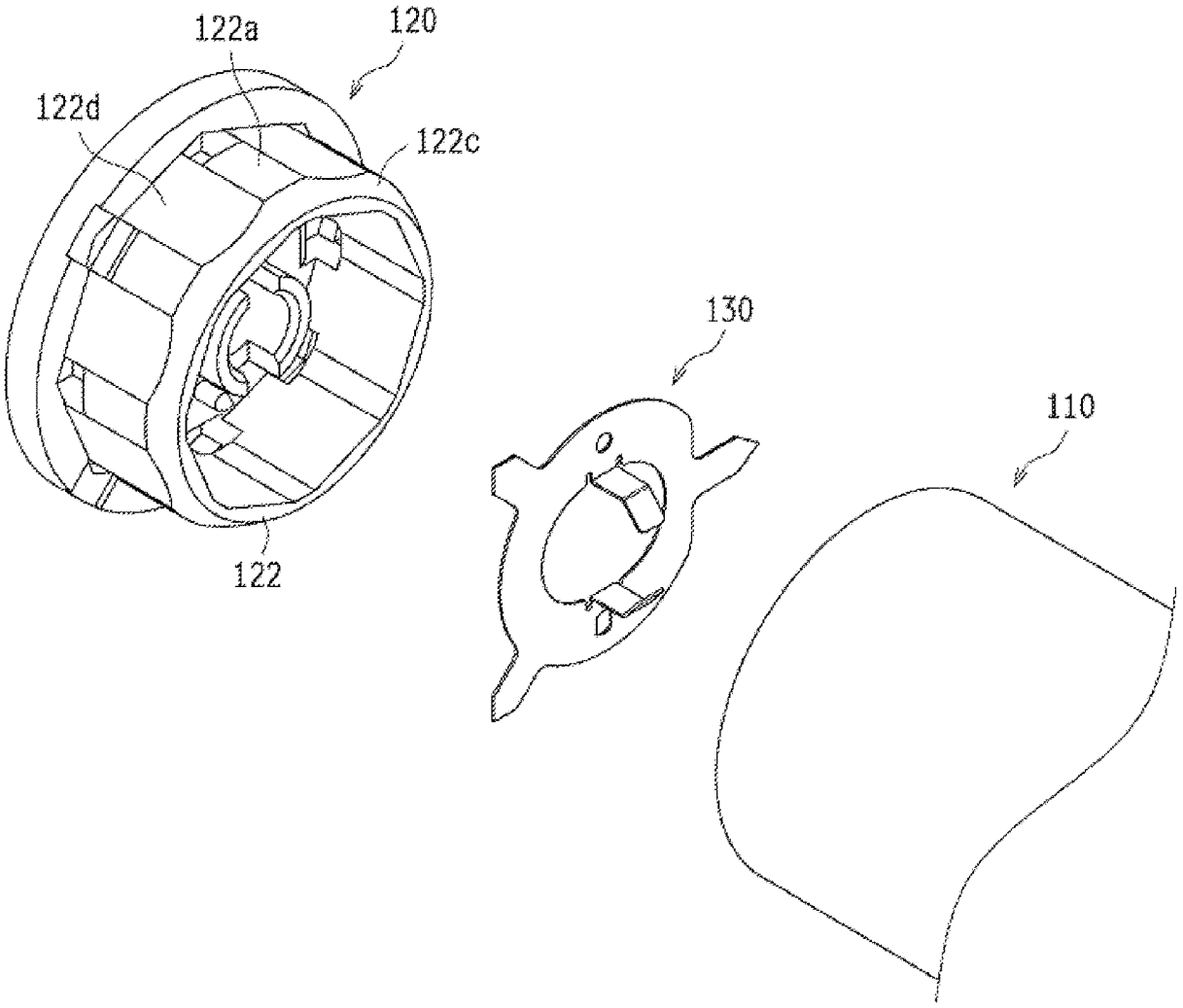
FIG. 7 is an exploded perspective view of a photosensitive drum according to Embodiment 2 as viewed from one end side thereof.

In Embodiment 2, a variant of the drum flange 120 in the photosensitive drum 100 will be described. FIG. 7 is an exploded perspective view of a photosensitive drum 100 according to Embodiment 2 as viewed from one end side thereof.

A drum flange 120 according to Embodiment 1 has the press-in boss 122 whose non-contact is formed as the oppositely-facing partial cylindrical surface 122*b*. However, in the present disclosure, the shape of the non-contact of the press-in boss 122 is not particularly limited. As illustrated in FIG. 7, the drum flange 120 in Embodiment 2 has a press-in boss 122 whose contact is a partial cylindrical surface 122*a*, but whose non-contact is formed as a non-contact plane 122*d*. Furthermore, the press-in boss 122 illustrated in FIG. 7 has also a tapered surface 122*c* which is formed on its press-fit side to facilitate insertion of the press-in boss 122 into the drum element tube 110.

When the drum flange 120 illustrated in FIG. 7 is press-fitted to the drum element tube 110, the non-contact planes 122*d* serve as the relief allowance for the partial cylindrical surfaces 122*a*, whereby the contact pressure between the drum element tube 110 and the partial cylindrical surfaces 122*a* is able to be made uniform. As a result, occurrence of distortion of the drum element tube 110 caused by press-fitting of the drum flange 120 is able to be suppressed, and therefore runout of the photosensitive drum 100 during its rotation is able to be suppressed.

Embodiment 3

Figure 8:
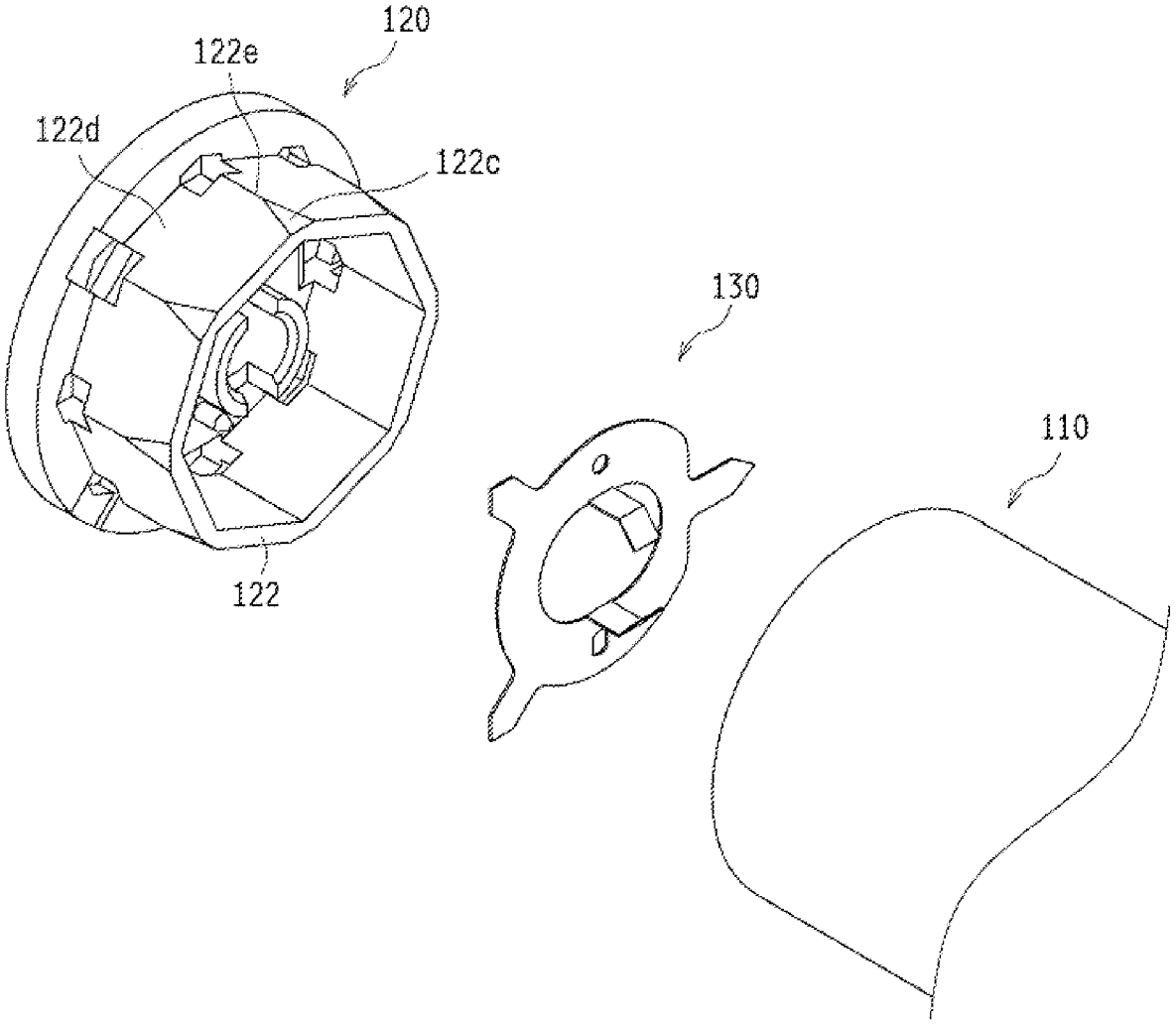
FIG. 8 is an exploded perspective view of a photosensitive drum according to Embodiment 3 as viewed from one end side thereof.

In Embodiment 3, another variant of the drum flange 120 in the photosensitive drum 100 will be described. FIG. 8 is an exploded perspective view of a photosensitive drum 100 according to Embodiment 3 as viewed from one end side thereof.

In the drum flange 120 according to Embodiments 1 and 2, the press-in boss 122 includes contacts each formed as the partial cylindrical surface 122*a*. However, according to the present disclosure, the shape of the contact in the press-in boss 122 is not particularly limited (the contact may not be a surface). As illustrated in FIG. 8, a drum flange 120 according to Embodiment 3 has a polygonal cross-section orthogonal to the axial direction of the press-in boss 122, and the contact in the press-in boss 122 is a contact ridge 122*e*, which is a ridge of a polygonal configuration. Furthermore, a non-contact in the press-in boss 122 is a non-contact plane 122*d*. The press-in boss 122 illustrated in FIG. 8 has also a tapered surface 122*c* which is formed on the press-fit side of the contact ridge 122*e* to facilitate insertion of the press-in boss 122 into the drum element tube 110.

When the drum flange 120 illustrated in FIG. 8 is press-fitted to the drum element tube 110, the non-contact planes 122*d* serve as the relief allowance for the contact ridges 122*e*, whereby the contact pressure between the drum element tube 110 and the contact ridges 122*e* is able to be made uniform. As a result, occurrence of distortion of the drum element tube 110 caused by press-fitting of the drum flange 120 is able to be suppressed, and therefore runout of the photosensitive drum 100 during its rotation is able to be suppressed.

Embodiment 4

Figure 9:
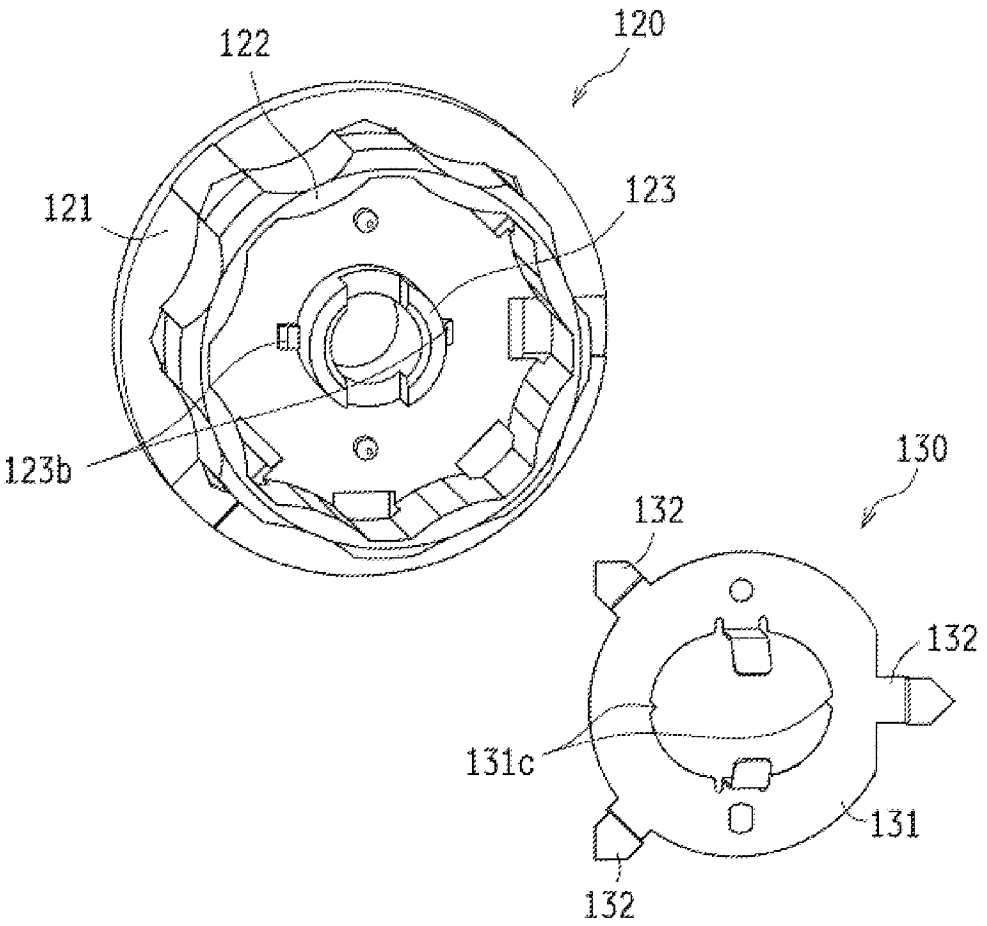
FIG. 9 is an exploded perspective view illustrating a photosensitive drum according to Embodiment 4 with a drum flange and a grounding plate being pulled out.

In Embodiment 4, a variant of the grounding plate 130 in the photosensitive drum 100 will be described. FIG. 9 is an exploded perspective view illustrating a photosensitive drum 100 according to Embodiment 4 with a drum flange 120 and a grounding plate 130 being pulled out.

The grounding plate 130 described in Embodiment 1 is configured to conduct with the drum element tube 110 by contacting the tip of the drum contact claw 132 with the end face of the drum element tube 110. However, in the present disclosure, the drum contact claw 132 of the grounding plate 130 may be brought into contact with the inner circumferential surface of the drum element tube 110 in place of end face thereof.

As illustrated in FIG. 9, the grounding plate 130 according to Embodiment 4 is different from the grounding plate 130 illustrated in FIG. 3 in terms of the shape of the drum contact claw 132. The grounding plate 130 illustrated in FIG. 9 has a drum contact claw 132 which is bent so as to be raised to be perpendicular to the ring 131 at a radially intermediate portion of the ring 131, and is further bent radially outward at its tip. To this end, even when the ring 131 of the grounding plate 130 is disposed in contact with the drum-facing surface of the flange 121, the tip of the drum contact claw 132 is allowed to make contact with the inner circumferential surface of the drum element tube 110. However, even in this configuration, the drum contact claw 132 is in contact with the inner circumferential surface near the end face of the drum element tube 110, so that production of metal powder due to rubbing the inner circumferential surface of of the drum element tube 110 by the drum contact claw 132 is able to be suppressed.

Furthermore, the drum flange 120 and the grounding plate 130 may include a retaining mechanism for preventing the grounding plate 130 from being pulled from the drum flange 120. As illustrated in FIG. 9, this retaining mechanism is composed of a first engaging projection 131*c* provided on the ring 131 of the grounding plate 130, and a second engaging projection 123*b* provided on the shaft holding boss 123 of the drum flange 120.

The first engaging projection 131*c* is formed in a manner extending radially inward from the inner circumferential edge of the second opening 131*a* of the ring 131. It is preferable that a plurality of first engaging projections 131*c* is provided for each grounding plate 130 (in this example, provided at two locations). The second engaging projection 123*b* is formed in a manner extending radially outward from the outer circumferential surface of the shaft holding boss 123 at a position corresponding to the first engaging projection 131*c* in a manner slightly spaced from the drum-facing surface of the flange 121. When the grounding plate 130 is attached to the drum flange 120, the first engaging projection 131*c* and the second engaging projection 123*c* engage each other, so that falling out of the grounding plate 130 from the drum flange 120 is able to be prevented.

The embodiments disclosed herein are illustrative in every respect, and do not serve as a basis for limitative interpretation. Therefore, the technical scope of the present disclosure should not be interpreted only based on the embodiments described above, but is defined based on the description in the scope of the claims, and is intended to include any modifications within the scope and meaning equivalent to the terms of the claims.

What is claimed is:

1. A photosensitive drum comprising:

a drum element tube; and a drum flange to be press-fitted to an end of the drum element tube, wherein the drum flange includes a flange disposed to face an end face of the drum element tube, and a press-fitting formed on a drum-facing surface of the flange so as to be press-fitted to an inner circumferential side of the drum element tube, the press-fitting has an outer circumferential surface formed with a plurality of contacts to be in contact with an inner circumferential surface of the drum element tube and a plurality of non-contacts to be not in contact with the inner circumferential surface of the drum element tube, the contacts and the non-contacts being circumferentially alternated, and a first opening is formed on a proximal end side of each contact of the press-fitting so as to penetrate a part of the press-fitting.

2. The photosensitive drum according to claim 1, wherein each of the contacts has an arc shape when viewed from an axial direction of the photosensitive drum.

3. The photosensitive drum according to claim 1, wherein each of the non-contacts has an oppositely-facing circular arc shape that is concave toward a center of the press-fitting when viewed from an axial direction of the photosensitive drum.

4. The photosensitive drum according to claim 1, further comprising a grounding plate attached to the drum flange, wherein the drum flange includes a shaft holding boss formed at a center of the flange inside the press-fitting, the shaft holding boss holding a drive shaft for rotationally driving the photosensitive drum, the grounding plate includes:

a ring disposed in contact with the drum-facing surface of the flange between the press-fitting and the shaft holding boss, the ring being centrally provided with a second opening through which the shaft holding boss extends;

a drum contact claw formed to extend radially outward from an outer circumferential edge of the ring; and a shaft contact claw formed to extend radially inward from an inner circumferential edge of the second opening, when the drum contact claw is inserted in the first opening, a tip of the drum contact claw protrudes radially outward from the outer circumferential surface of the press-fitting, whereby the drum contact claw is brought into contact with an end face or an inner circumferential surface of the drum element tube, and the shaft contact claw is brought into contact with an outer circumferential surface of the drive shaft held by the shaft holding boss.

5. A process unit removably loaded in an image forming apparatus, comprising a photosensitive drum around which at least some of functional components necessary for electrophotographically forming an image are arranged along a rotational direction of the photosensitive drum, wherein the photosensitive drum is the photosensitive drum as claimed in claim 1.

6. An image forming apparatus comprising the process unit according to claim 5.

* * * * *